US005223095A

United States Patent [19]

Kinsley, Jr.

[11] Patent Number: 5,223,095

[45] Date of Patent: Jun. 29, 1993

[54] HIGH TEAR STRENGTH, HIGH TENSILE STRENGTH PAPER

[75] Inventor: Homan B. Kinsley, Jr., Powhatan, Va.

[73] Assignee: Custom Papers Group Inc., Richmond, Va.

[21] Appl. No.: 644,503

[22] Filed: Jan. 23, 1991

[51] Int. Cl.[5] ..... D21H 13/10

[52] U.S. Cl. ..... 162/146; 162/168.1; 162/169; 162/181.1

[58] Field of Search ..... 162/146, 168.1, 169, 162/181.1; 51/400

[56] References Cited

U.S. PATENT DOCUMENTS

| | | | |
|---|---|---|---|
| 2,899,351 | 8/1959 | Morse | 162/146 |
| 3,020,178 | 2/1962 | Sweeney et al. | 162/146 |
| 3,032,465 | 5/1962 | Selke et al. | 162/146 |
| 3,085,906 | 4/1963 | Harmon et al. | 162/146 |
| 3,135,590 | 6/1964 | Campbell et al. | 162/146 |
| 3,489,643 | 1/1970 | Hoffman | 162/146 |

FOREIGN PATENT DOCUMENTS

| | | | |
|---|---|---|---|
| 1909488 | 8/1970 | Fed. Rep. of Germany | 162/146 |
| 45-14121 | 5/1970 | Japan | 162/146 |
| 2003953 | 3/1979 | United Kingdom | 162/146 |

OTHER PUBLICATIONS

Battista, *Synthetic Fibers in Papermaking*, (1964), Intersci. Publ., p. 290.

*Primary Examiner*—Peter Chin

*Attorney, Agent, or Firm*—Burns, Doane, Swecker & Mathis

[57] ABSTRACT

Provided is a high tear strength, high tensile strength paper product. The product comprises a wood pulp fiber, a non-cellulosic synthetic fiber having a tear strength enhancing denier and length, and a binder material. The resulting paper product exhibits a combination of tear strength and tensile strength which can equal that of cotton cloth of the same basis weight, and can therefore be used as a less expensive substitute for cotton cloth in many applications.

27 Claims, No Drawings

HIGH TEAR STRENGTH, HIGH TENSILE STRENGTH PAPER

BACKGROUND OF THE INVENTION

The present invention pertains generally to high tear strength, high tensile strength paper products. More particularly, this invention relates to high tear strength, high tensile strength paper products useful as a substitute for woven products such as cotton cloth of the same basis weight.

Woven products are very versatile materials. One of the reasons for their wide versatility is that they possess not only a high tensile strength, but also a high tear strength. Cotton cloth for example, is currently used in place of paper in many applications, such as backings for abrasive materials, because paper does not possess the requisite combination of tear and tensile strength.

There have been various attempts to increase generally the strength of paper materials. One of these methods is the preparation of paper and non-woven fabric from synthetic fibers disclosed in U.S. Pat. No. 3,200,033. Specifically, the object of the invention is to provide a method where a latex adhesive is added only in an amount necessary for bonding the crossing points of the non-woven fiber. The preferred latex adhesive is a polyurethane forming mixture of polyesters and polyisocyanates whose isocyanate groups are blocked by an alcohol or phenol and become reactive only at a temperature of about 100° C.

Another method of increasing the strength of paper products is found in Pontius U.S. Pat. No. 4,504,290. Pontius relates to a sheet material comprising a combination of cellulose and synthetic fiber in a weight percentage range from between at least 30 to 50% of cellulose fibers and 1 to 10% of synthetic fibers.

Brandon et al U.S. Pat. No. 4,512,849 demonstrates that in some instances, in order to increase the initial wet web strength, hydrated (fibrillated) wood or other natural fibers and/or fibrillated, synthetic fibers have been combined with non-fibrillated, synthetic fiber finishes. Such combinations have tended to hold non-woven webs together while they have been transferred from a moving, forming wire across unsupported draws, to wet presses or other treating equipment, where a binder has been added to hold the fibers together more permanently. However, the use of the fibrillated, natural or synthetic fibers as part of the finish has not proven satisfactory for non-wovens intended for use as replacement fabrics for textiles. This has been because of the stiff, "papery" hand imparted by these fibrillated fibers to the resulting non-wove fabrics. The solution of Brandon et al, is a composition of at least 50% by weight of staple length, synthetic, hydrophobic fibers having a length to diameter ratio of about 1000:3000 and a length of at least ½ inch.

U.S. Pat. No. 4,865,691 discloses a method for internally strengthening products from fibrous materials characterized by the use of a wet-end additive. The wet-end addition is a particular grade of polyvinyl alcohol which is super-hydrolyzed and which is substantially insoluble in water maintained at 130° F.

The problem with the aforementioned processes, however, is that they achieve only an increased tear or tensile strength but not the requisite combination of a high tear strength and high tensile strength that would be necessary to replace woven fabrics of the same basis weight. For this reason, woven fabrics such as cotton cloth continue to be used in numerous applications as opposed to paper because, as was mentioned, they possess a superior combination of tear and tensile strength compared to paper products of the same basis weight.

Accordingly, it is an object of the present invention to provide a high tear strength, high tensile strength paper product.

It is another object of the present invention to provide a high tear strength, high tensile strength paper product with a tear strength and tensile strength at least equal to that of cotton cloth of the same basis weight.

It is yet another object of the present invention to provide a high tear strength, high tensile strength paper product which is of lower cost to produce than is a cotton cloth of the same basis weight possessing similar tear and tensile strength.

Still another object of the present invention is to provide a paper product that has a tear and tensile strength at least equal to that of cotton cloth of the same basis weight which is also less permeable than cotton cloth and possesses a final surface that is smoother than that of cotton cloth.

These and other objects of the present will become apparent to the skilled artisan upon a review of the following specification and the claims appended thereto.

SUMMARY OF THE INVENTION

In accordance with the foregoing objectives, there is provided a high tear strength, high tensile strength paper product which is comprised of a wood pulp fiber which has added to it a combination of a synthetic non-cellulosic fiber having a tear strength enhancing denier and length and a binder material. The synthetic fiber and binder material are added to the wood pulp in amounts sufficient to impart to the paper product a tear and tensile strength at least equal to cotton cloth of the same basis weight.

In a preferred embodiment, the paper product of the present invention comprises wood pulp fiber in an amount of from about 60 to about 90 weight %, from about 1 to about 20 weight % of a synthetic fiber having a denier of from about 5 to about 15 and a length of at least 0.25 to about 0.75, and from about 1 to about 20 weight % of a binder material.

DETAILED DESCRIPTION OF THE PREFERRED EMBODIMENTS

The high tear strength, high tensile strength paper product of the present invention is comprised of a wood pulp fiber which has added to it a combination of synthetic fiber and binder material. If a suitable wood pulp fiber, synthetic fiber and binder material are combined in the proper amounts, the resulting paper product possesses a tear and tensile strength at least equal to that of cotton cloth of the same basis weight.

The availability, cost, and ease in processing wood pulp makes it a highly desirable and very economical material and as such, wood pulp is very well known in the art. There are, however, a myriad of different wood pulps readily available, all possessing different tear and tensile strengths. The present invention seeks to increase the combination of tear and tensile strength, and accordingly, it would be desirable to use a wood pulp that initially possesses a high tear factor and a high tensile strength. Specifically, the present invention contemplates the use of a wood pulp that possesses a tear factor of at least 70 at a freeness of about 250 ml CSF. More preferably, a tear factor of at least 90 at a freeness of 250 ml CSF, and most preferably, the present invention contemplates the use of a wood pulp fiber that possesses a tear factor of at least 120 at a freeness of 250 ml CSF.

There are a number of commercially available pulps which possess good tear at 250 ml CSF. Representative examples of pulp with a tear factor of at least 120 at a freeness of 250 ml CSF are listed in the following table according to commercial names along with the species of wood, specific tear factor and the breaking length of each.

| Identification | Wood Species | Tear Factor | Breaking Length |
|---|---|---|---|
| Domtar Q30 UB* | Spruce/Jack Pine | 120 | 13.0 |
| Espanola UB | Spruce/Jack Pine | 134 | 11.0 |
| EDS UB, Sweden | Fir/Scotch Pine | 123 | 11.5 |
| Deerskin UB | Southern Pine | 131 | 10.5 |
| Georgianier | Southern Pine | 120 | 11.0 |
| Leaf River | Souhtern Pine | 123 | 9.8 |
| NBFA | Southern Pine | 123 | 8.5 |
| Pinnacle | Southern Pine | 120 | 10.5 |
| Alberni UB | Douglas Fir/Cedar | 122 | 11.3 |
| Alberni RLC UB | Hemlock/Fir/Cedar | 120 | 11.3 |
| Crofton SB | Douglas Fir | 126 | 11.7 |
| Crofton UB | Douglas Fir | 138 | 10.6 |
| Harmac SB | Spruce/Cedar/Hemlock | 130 | 11.7 |
| Howe Sound | Spruce/Cedar/Hemlock | 125 | 10.6 |
| Humbolt | Redwood/Douglas Fir | 123 | 9.8 |
| LP-90 | Redwood/Douglas Fir | 134 | 10.0 |
| Newskraft | Douglas Fir | 128 | 10.3 |
| Pacifica | Redwood/Douglas Fir | 120 | 9.5 |
| Samoa | Redwood/Douglas Fir | 135 | 10.6 |
| Sequoya | Redwood | 126 | 10.1 |
| Tacoma UB | Douglas Fir | 130 | 10.7 |
| Wauna | Douglas Fir | 130 | 9.1 |
| Weyerhauser | Douglas Fir | 122 | 10.0 |

*The letter codes associated with the pulp names have the following meanings: UB = Un-Bleached and SB = Semi-Bleached.

These pulps are merely representative of those that have a tear of at least 120 at a freeness of 250 ml CSF and are not meant to limit the scope of the wood pulp fibers which are suitable for use according to the present invention.

The fiber length and fiber width as well as the wood species are worthy of consideration when selecting an appropriate wood fiber. Generally, an appropriate fiber length ranges from about 1.0 to about 6.0 mm and an appropriate fiber width ranges from about 20 to about 80 μm. Preferably, however, the fiber length ranges from about 1.5 to about 5.0 mm and the fiber width ranges from about 25 to about 70 μm.

Representative examples of suitable species of wood and their corresponding fiber length (mm) and fiber width (μm) are shown in the following table. While representative, these examples are by no means exhaustive.

| Wood Species | Fiber Length (mm) | Fiber Width (μm) |
|---|---|---|
| Cedar, Western | 3.5 | 30–40 |
| Fir, Douglas | 3.9 | 35–45 |
| Fir, White | 3.4 | 35–45 |
| Hemlock | 3.0–4.2 | 28–40 |
| Pine, Jack | 3.5 | 28–40 |
| Pine, Scotch | 1.8–4.4 | 38 |
| Pine, Southern | 3.6–4.6 | 35–45 |
| Redwood | 7.0 | 50–65 |

-continued

| Wood Species | Fiber Length (mm) | Fiber Width (μm) |
|---|---|---|
| Spruce | 3.3–3.5 | 25–30 |

As was mentioned, the commercial availability, cost, and ease in processing of wood pulp makes it a highly desirable and very economical material. Accordingly, it has been and continues to be used as a major component of most paper products. Alone, however, it is unable to replace cotton cloth of the same basis weight in many applications because it lacks sufficient tear strength to perform the same functions as the cotton cloth. Therefore, it is necessary to increase the tear strength of the paper formed from the wood pulp through the addition of other materials.

When non-cellulosic synthetic fibers are incorporated with the wood pulp fiber an unusual phenomenon occurs. Synthetic fibers which are non-cellulosic are generally stronger in tensile strength than are wood fibers, but are less bonded in a sheet than a cellulose fiber. When the sheet is torn, the synthetic fibers do not rupture, but pull out of the sheet structure. This requires more work than simple fiber rupture. This means that the tear strength will improve as the synthetic fiber content is increased. At some point, however, the quantity of synthetic fibers will so disrupt the sheet structure that there will be a reduction in the cellulose to cellulose fiber bonding, which will cause a loss in tensile strength. It is desirable, therefore, to add a sufficient amount of synthetic fiber to increase the tear strength without disrupting the sheet structure to the point that the tensile strength is decreased below the acceptable level. It is further preferred that the amount of synthetic fiber incorporated into the paper product range from about 5 to about 15 % of the total weight of the paper product. It is most preferred that the amount of synthetic fiber incorporated range from about 7.5 to about 12.5 % of the total weight of the paper product.

The present invention contemplates the use of virtually any non-cellulosic synthetic fiber known in the art that possesses sufficient tensile strength. Examples of such synthetic fibers include polyamides such as nylon 66, nylon 6 and other nylon products (nylon 6–10; nylon 11); polyesters from dicarboxylic acids, such as terephthalic or isophthalic acid and diols or polyols (Dacron, Diolan, Terylene); vinyl polymers and copolymers on vinyl chloride or vinyl acetate bases (Vinyon); vinylidene chloride polymers and copolymers ("Saran"); polyacrylics (Dralon, Orlon, Acrylan, Creslan, Acrylast) and copolymers, e.g., of acrylonitrile with styrene, polyolefins such as polyethylene or polypropylene and polytetrafluoroethylene (Teflon). Mixtures of synthetic fibers can also be employed. It would also be possible, according to the present invention, to use high modulus synthetic fibers such as Kevlar. Such high modulus synthetic fibers, however, may not be cost effective.

Also important in the consideration of an appropriate synthetic fiber is its length. If the amount of non-cellulosic synthetic fiber incorporated into the wood pulp/synthetic fiber sheet structure is constant, the tear strength will increase as the length of the synthetic fiber increases. It is important to note, however, that as the length increases, the number of times the synthetic fiber is contacted by wood fibers increases. Since each fiber contact is an area of bonding, the total amount of synthetic fiber bonding increases as its length increases. At some point, however, the fibers become so bonded that they will break rather than pull out of the sheet structure during a tear test. This phenomenon tends to decrease the tear strength of the composite material since it takes less energy to break a fiber than it does to pull it out of the sheet structure. Thus, the tear strength, a measure of the energy required to make the sheet fail, will be reduced once the fiber length is increased to the degree that the synthetic fiber bonding exceeds the synthetic fiber strength. Therefore, it is desirable that the length of the synthetic fiber be increased in order to improve the tear strength without increasing the degree of fiber bonding to an extent such that virtually all the fibers break rather than tear out of the sheet structure. In general, it is preferred that the synthetic fiber has a length ranging from at least 0.25 to about 0.75 inch. It is more preferred that the synthetic fiber length range from about ⅜ to about ⅝ inch, and most preferably about 0.5 inch.

Another important aspect of the synthetic fiber which must be considered in determining the appropriate synthetic fiber and its length is its diameter. As just described, it is possible that by increasing the fiber length, the fiber will break rather than pull out of the sheet structure, thus decreasing the tear strength of the paper product. This reduction in tear strength can be prevented by increasing the diameter of the fiber. As the diameter of the fiber is increased, each fiber becomes stronger and will therefore be able to pull out of the paper matrix without breaking. Thus, it is possible to find the optimum diameter for each fiber length to assure that the fibers are significantly strong to prevent their breaking when the sheet is torn.

The tensile strength is a measure of the force required to cause a strip of the paper to break. Tensile strength of cellulose fiber paper is influenced by the cellulose fiber length, the fiber strength, and the degree of fiber bonding. The system becomes more complex when a binder and synthetic fibers are added to the cellulose fiber paper. Even with a binder present, the addition of a synthetic fiber to a cellulose fiber paper may not improve the tensile strength. The synthetic fiber interferes with the cellulose fiber to cellulose fiber bonding. It has been observed that at a constant level of synthetic fiber in a paper, the tensile strength will increase as the diameter of the synthetic fiber is increased. This is due to the reduction in the number of synthetic fibers. Smaller numbers of synthetic fibers will have a smaller negative impact on the cellulose fiber to cellulose fiber bonding.

For the strongest paper in both tensile and tear, the synthetic fiber should have a length of at least 0.25 to about 0.75 inch and a diameter which corresponds to a denier of about 5 to 15. It is more preferred that the length should be ⅜ to ⅝ inch while the diameter corresponds to a denier of about 6 to 12.

The third component of the paper product of the present invention is a binder material. The binder material is incorporated in order to increase the degree of bonding between the wood pulp fiber and the synthetic fiber thereby allowing a higher denier and longer synthetic fiber to be used without the early rupture from the sheet structure that would otherwise accompany the higher denier and longer synthetic fibers.

The present invention contemplates the use of virtually any latex binder material wherein the glass transition temperature of said binder is higher than that of the temperature of the process water used on the paper machine. The relatively high glass transition temperature is important because if the binder is precipitated at a temperature which is higher than the glass transition temperature of the binder, the paper never develops the required degree of bonding. The present invention also contemplates, however, the use of other binder materials such as powdered polymeric binders.

In general, the preferred binder materials are polymeric binders. Such binders are most preferably in the form of an aqueous latex, e.g., acrylic and styrene-butadiene latex materials, or powder, e.g., a polyvinyl alcohol powder or acrylic powder.

As the binder material will be added as part of the composition of the final paper product, it is also desirable that the binder material possess good wet strength, high surface free energy, and that the binder bond well to the synthetic fibers. For example, it is possible to use a soft latex material and thereby increase the tear strength. The latex material can, however, be so soft that it stretches to the point that it fails to bond the fiber structure together, thus resulting in a low tensile strength. This should be avoided.

The process for producing the paper product of the present invention begins logically with the preparation of the wood pulp. The wood pulp may be refined by any suitable method known in the art. One such method would be to pass the pulp through a Jylha Conical O Sund's refiner until the appropriate freeness has been achieved. The beaten wood pulp can be combined with unbeaten wood pulp but the beaten and unbeaten pulps must be sufficiently mixed and it is important that the required levels of freeness be achieved whether or not unbeaten pulp is added.

To the refined/beaten pulp is added the desired synthetic fiber and binder material. The synthetic fiber and binder material may be added directly to the wood pulp and the binder material is then precipitated by either the direct addition of alum or by reverse alum addition. The alum is added to the mixture until the pH of the mixture reaches approximately 4.5. At this point the composition is complete and the mixture is ready to be formed into the final paper product.

The binder can also be incorporated into the paper product by depositing a latex on the fiber surface prior to sheet formation. Or, if the binder is in the form of a powder or fibrid, by adding a finely divided polymer powder or polymer fibrid to the furnish. An alternate manner of incorporating the binder into the final product is to coat or saturate the paper web after it is formed with a latex or polymer solution. It should also be noted that another say of achieving the desired bonding of the synthetic fiber is to parchmentize (using $H_2SO_4$) or vulcanize (using $ZnCL_2$) the sheet to thereby inherently produce a cellulosic binder (from the cellulose fibers).

In order to increase the paper density, the paper product mixture needs to be wet pressed. One such method for wet pressing the paper in the laboratory is through the use of a Noble weed wet press. If a Noble wood wet press is used, the paper should be pressed to the maximum load allowed.

The paper product, after being wet pressed, is ready to be dried. Any method known to the art may be used to dry the paper product of the present invention but it is preferred to dry the handsheet on a stream drum. If a latex is used to bond the fibers, then the handsheet must be heated to a temperature above the glass transition temperature of the binder. After this heating step, it is then ready to condition to Tappi standards.

The dried and conditioned handsheet is then further processed according to the respective application for which it is to be employed.

The invention will be illustrated in greater detail by the following specific examples. It is understood that these examples are given by way of illustration and are not meant to limit the disclosure or the claims to follow. All percentages in the examples, and elsewhere in the specification, are by weight unless otherwise specified.

EXAMPLES

The paper product for the following examples was prepared by first mixing the required amount of beaten pulp and the desired quantity of synthetic fiber. To the wood pulp/synthetic fiber combination was added the appropriate weight percent of latex or other binder based on the total weight of the final solution. If a latex was used as the binder, the latex was precipitated out by the addition of alum, and a paper product handsheet was formed at a 200 lb per 3000 sq. ft. basis weight. The handsheet was then wet pressed with the maximum load allowed by the Nobel Wood wet press and dried on a Teflon covered steam drum with minimum felt tension. The dried handsheets were then conditioned to Tappi standards and tested to determine their physical properties.

EXAMPLE 1

The first experiment was conducted in order to test the effect that a varied amount of synthetic fiber incorporated into the paper product had on the tear and tensile strength of the final paper product. The synthetic fiber incorporated into the paper product was a polyester fiber and the amounts tested ranged from 0.0 to about 20%. The paper handsheet was constructed using a polyester fiber of 0.25 inches in length and 1.5 denier, a Marathon TM pulp and an acrylic latex. The tear and tensile strength as well as the amount of stretch accompanying the tear or break of each test sample were measured and are recorded in Table 1.

TABLE 1

| Polyester (%) | Caliper (inch) | Tear (gf) | Tensile (lb/inch) | Stretch (%) |
|---|---|---|---|---|
| 0 | 0.016 | 520 | 152 | 4.7 |
| 5 | 0.017 | 482 | 164 | 8.1 |
| 10 | 0.018 | 527 | 149 | 6.8 |
| 20 | 0.20 | 732 | 116 | 5.2 |

The data in Table 1 suggest that the incorporation of a synthetic fiber as well as a binder material to the wood pulp fiber did, in fact, increase the tear strength of the resulting paper product over a simple wood pulp fiber/-binder product once the percent of synthetic fiber incorporated was at least 10%. The tear strength of the paper product improved markedly when the amount of the polyester fiber approached 20% but the tensile strength of the paper product was adversely affected as the tear strength improved, and especially as the amount of the synthetic fiber incorporated approached 20%.

Furthermore, the data suggest that the denier and the length of the synthetic fiber were inadequate to achieve the desired combination of tear and tensile strength. As the synthetic fiber content increased, the tear began to approach the desired level but at the same time the tensile began to deteriorate. Examination of the broken ends of the tear or tensile test strips revealed very little long fiber. The edges were clean, not fuzzy. This suggested that the fibers were breaking and not pulling out of the structure during the tests.

EXAMPLE 2

The following experiment used the same Marathon TM pulp and binder material as was employed in Example 1. The length and denier of the synthetic fiber was increased in order to increase the tear and tensile strength of the paper product. Accordingly, handsheets were made using polyester synthetic fibers with denier of 3 and 12, and a length of 0.5 inches. The amount of synthetic fiber added to the paper composition was 10%. The tear and tensile strengths as well as the percent stretch of the test samples were tested and the results are recorded in Table 2.

TABLE 2

| Polyester/ Denier (%) | Caliper (inch) | Tear (gf) | Tensile (lb/inch) | Stretch (%) |
|---|---|---|---|---|
| 10/3.0 | 0.016 | 295 | 162 | 6.3 |
| 10/12.0 | 0.020 | 1097 | 161 | 8.2 |

The data in Table 2 indicate that by increasing the denier of the polyester synthetic fiber it was possible to significantly increase the tear strength without substantially affecting the tensile strength of the paper product. Furthermore, an examination of the broken edges of the 3 denier test samples demonstrated that there was a clean, sharp break rather than a fuzzy edge, thus indicating that the fibers had broken without any substantial pulling out of the sheet structure. An examination of the 12 denier test samples, on the other hand, showed edges that were fuzzy, thus indicating that the individual fiber tensile strength exceeded the bond strength of the paper and therefore the fiber pulled out of the sheet structure on both the tear and tensile strength tests.

EXAMPLE 3

The following experiment was conducted in order to demonstrate the effect that incorporating different binder materials had on the tear and tensile strength of the final paper product. The experimental runs also demonstrate the superior tensile and tear strengths obtained when employing a synthetic fiber having a length of about 0.5 inch and a denier in the range of 6–12.

Specifically, the two binder materials tested were a styrene latex G (Goodrite TM 1800×73) and an acrylic latex H (Hycar TM 26391). The type, percent, denier and length of the synthetic fiber were held constant at the parameters indicated in Table 3 except that the denier was 6 for set one as opposed to 12 for sets two and three. The pulp employed in this example was a Marathon TM pulp with a freeness of 230 ml CSF. Sets one and two used reverse alum addition of the latex while set three used normal alum addition. The tear and tensile strengths were tested and the results are recorded in Table 3.

TABLE 3

| Latex | Polyester %/Denier/Length | Tensile (lb/inch) | Tear (gf) |
|---|---|---|---|
| G | 10/6/0.5 | 145 | 1119 |
| H | 10/6/0.5 | 163 | 1240 |
| G | 10/12/0.5 | 156 | 1023 |
| H | 10/12/0.5 | 146 | 931 |
| G | 10/12/0.5 | 168 | 1024 |
| H | 10/12/0.5 | 174 | 908 |

The paper product employing the acrylic latex demonstrated a greater tear strength than that employing the styrene latex where the synthetic fiber denier was 6, whereas the paper product employing the styrene latex demonstrated a slightly greater tear strength than that employing the acrylic latex where the synthetic fiber denier was 12. The normal/reverse alum addition seemed to have little appreciable effect on the tensile strength and even less on the tear strength.

EXAMPLE 4

The effect on tear and tensile strength of different wood pulp fibers was examined by comparing one handsheet prepared with a Marathon TM pulp, styrene latex (10%) and polyester synthetic fiber (10%) to a second handsheet prepared with a Powell River TM pulp, styrene latex (10%) and polyester synthetic fiber (10%). The tear strength, tensile strength and percent stretch were measured and the results recorded in Table 4 below.

TABLE 4

| Pulp | Polyester %/Denier/Length | Tensile (lb/Inch) | Stretch (%) | Tear (gf) |
|---|---|---|---|---|
| PR | 10/6/0.5 | 145 | 9.0 | 1119 |
| M | 10/6/0.5 | 133 | 6.8 | 1188 |

EXAMPLE 5

The following experiment was conducted in order to evaluate the effect that varying the freeness of the wood pulp has upon the tear and tensile strength of the resulting paper product incorporating a synthetic fiber and latex material. The handsheets were formed from a Powell River TM pulp beat to various freeness combined with 10% polyester fiber of 6.0 denier and 10% styrene latex. In the last run the handsheet was formed from Powell River TM pulp (60% beaten and 20% unbeaten) with 10% polyester synthetic fiber and 10% styrene latex. The tear strength, tensile strength, percent stretch and the stiffness were measured and the results are recorded in Table 5.

TABLE 5

| Freeness (ml) | Tensile (lb/Inch) | Stretch (%) | Tear (gf) | Stiffness (Gurley mg.) |
|---|---|---|---|---|
| 581 | 152 | 5.8 | 1271 | 8757 |
| 478 | 141 | 5.6 | 1333 | 8245 |
| 336 | 151 | 5.7 | 1280 | 8179 |
| 478 | 149 | 5.3 | 1386 | 6801 |

The paper product with the combined beaten and unbeaten wood pulp demonstrated superior tear and tensile strength and a decreased stiffness as compared to a paper product produced from only a beaten wood pulp of the same freeness.

EXAMPLE 6

The following experiment was conducted in order to investigate the effect of using a nylon synthetic fiber in place of the polyester synthetic fiber used in the previous examples. The handsheets were prepared with a Marathon TM wood pulp beaten to a freeness of 230 ml CSF and a styrene latex. The amount of the synthetic fiber employed, the denier and length of the synthetic fiber are all indicated in Table 6 along with the results of the tear and tensile strengths of the paper product test samples. All nylon fibers were nylon 6,6 except the 15 denier fibers which were nylon 6.

TABLE 6

| Percent of sheet | Denier | Length (inch) | Basis Wt. (lb/Rm) | Tear (gf) | Tensile (lb/in) | Stretch (%) | Cal. (ml) |
|---|---|---|---|---|---|---|---|
| | | | NYLON FIBER | | | | |
| 5 | 3 | 0.25 | 215 | 729 | 143 | 8.1 | 19.8 |
| 10 | 3 | 0.25 | 210 | 910 | 125 | 6.6 | 21.1 |
| 5 | 3 | 0.5 | 210 | 803 | 146 | 7.9 | 20.5 |
| 10 | 3 | 0.5 | 215 | 986 | 127 | 7.2 | 21.9 |
| 5 | 6 | 0.25 | 216 | 791 | 146 | 7.8 | 20.8 |
| 10 | 6 | 0.25 | 213 | 880 | 126 | 7.8 | 20.6 |
| 5 | 6 | 0.5 | 217 | 894 | 141 | 7.3 | 21.5 |
| 10 | 6 | 0.5 | 218 | 1297 | 143 | 8.4 | 22.5 |
| 5 | 9 | 0.25 | 215 | 641 | 137 | 7.7 | 22.4 |
| 10 | 9 | 0.25 | 215 | 715 | 137 | 7.3 | 22.3 |
| 5 | 15 | 0.25 | 218 | 639 | 134 | 6.8 | 21.7 |
| 10 | 15 | 0.25 | 217 | 691 | 142 | 10.1 | 23.6 |
| 5 | 15 | 0.5 | 216 | 833 | 139 | 7.8 | 20.9 |
| 10 | 15 | 0.5 | 218 | 942 | 131 | 10.2 | 24.0 |
| | | | POLYESTER FIBERS | | | | |
| 10 | 12 | 0.5 | 206 | 1211 | 161 | 8.8 | 22.7 |
| 10 | 12 | 0.5 | 219 | 1271 | 166 | 7.8 | 22.9 |
| | | | NO SYNTHETIC FIBERS | | | | |
| | | | 206 | 455 | 142 | 7.2 | 19.0 |

Although the desired combination of tear and tensile strength can be achieved with the nylon fiber it proved not to be as desirable as the polyester fiber due to two disadvantages associated with the use of the nylon fiber. First, the nylon fiber was harder to handle in the paper mill system because it tended to tangle and rope more easily than did the polyester fiber. Secondly, the nylon fiber is more expensive than the polyester fiber.

It is important to note that the paper product according to the present invention exhibited significantly higher tensile strength and almost up to a threefold increase in tear strength compared to the paper product prepared from the Marathon TM pulp without any synthetic fiber or binder material additives.

EXAMPLE 7

Several trials were run on a four vat cylinder machine. The procedure was to refine northern softwood kraft pulp, to slurry 0.5 inch long 12 denier polyester fiber in water, to add the synthetic fiber to the pulp slurry, to slurry polyvinyl alcohol powder in water, and finally to add this to the pulp and synthetic fiber slurry to form the furnish for the run. The polyvinyl alcohol (PVOH) powder was a high molecular weight, super hydrolyzed, 120 mesh powder supplied by Air Products. It is commercially available as Air Products grade code Vinol 165SF.

The following table contains the data collected on the furnish and the machine conditions for the three trial runs which were made.

TABLE 7

| Trial | 1 | 2 | 3 |
|---|---|---|---|
| Pulp Freeness, ml CSF | 170 | 200 | 305 |
| Headbox Freeness, ml CSF | 308 | 437 | 622 |
| Headbox Consistency, % | 1.8 | 1.9 | 1.4 |
| Polyvinyl Alcohol Powder, % | 18 | 18 | 10 |
| Polyester Fiber, % | 10 | 10 | 10 |
| Basis Weight, Lb/3000 sq. ft. (grams/square | 209 | 181 | 197 |

TABLE 7-continued

| Trial | 1 | 2 | 3 |
|---|---|---|---|
| meter) | | | |
| Caliper, inch | 0.0169 | 0.0197 | 0.0168 |
| (mm) | 0.429 | 0.500 | 0.427 |
| Pounds per Point, BW/Mils | 12.4 | 9.2 | 11.7 |
| (grams/cubic centimeter) | 0.793 | 0.59 | 0.750 |
| Tensile, lb/inch | 180/94 | 202/94 | 175/73 |
| (kg/cm) | 32.2/16.8 | 36.1/16.8 | 36.1/13.0 |
| Tear, g | 1100/1310 | 662/826 | 624/770 |
| Ply Strength, g/cm | | | |
| top ply | 86.6+ | 86.6+ | 61.8 |
| middle ply | 86.6+ | 86.6+ | 81.5 |
| bottom ply | 86.6+ | 86.6+ | 64.2 |

The foregoing data indicate physical strength values which are exceptional. Typically, the tear value for a paper product is about 50% of what was obtained in the foregoing trial papers.

While the invention has been described with preferred embodiments, it is to be understood that variations and modifications may be resorted to as will be apparent to those skilled in the art. Such variations and modifications are to be considered within the purview and the scope of the claims appended hereto.

What is claimed is:

1. A high tear strength, high tensile strength paper product comprised of a wood pulp fiber in an amount from about 60 to about 98 weight %, a non-cellulosic synthetic fiber having a denier of about 5 to about 15, and length of from about 0.25 to about 0.75 inch in an amount from about 1 to 20 weight % and a binder material in an amount from about 1 to about 20 weight %, with the strength of the synthetic fiber exceeding the strength of synthetic fiber bonding to the wood pulp fiber such that the synthetic fiber tends to pull out of the paper product rather than rupture when the paper product is torn, and with the tensile strength being substantially maintained.

2. The paper product of claim 1, wherein the wood pulp fiber is present in an amount ranging from about 70 to about 90 weight %.

3. The paper product of claim 1, wherein the wood pulp fiber is present in an amount ranging from about 75 to about 85 weight %.

4. The paper product of claim 1, wherein the synthetic fiber is present in an amount ranging from about 5 to about 15 weight %.

5. The paper product of claim 1, wherein the synthetic fiber is present in an amount ranging from about 7.5 to about 12.5 weight %.

6. The paper product of claim 1, wherein the binder material is present in an amount ranging from about 5 to about 20 weight %.

7. The paper product of claim 1, wherein the binder material is present in an amount ranging from about 7.5 to about 20 weight %.

8. The paper product of claim 1, wherein the binder material is a latex.

9. The paper product of claim 1, wherein the binder material is derived from a polymeric powder.

10. The paper product of claim 1, wherein the binder is polyvinyl alcohol.

11. The paper product of claim 1, wherein the wood pulp fiber has a tear factor of at least 70 at a freeness of 250 ml CSF.

12. The paper product of claim 1 wherein, the wood pulp fiber has a tear factor of at least 120 at a freeness of 250 ml CSF.

13. The paper product of claim 1, wherein the wood pulp fiber is refined to a freeness of at least 150 ml CSF.

14. The paper product of claim 1, wherein the wood pulp fiber is refined to a freeness of at least 250 ml CSF.

15. A paper product of claim 1, wherein the synthetic fiber has denier of from about 6 to about 12.

16. The paper product of claim 1, wherein the synthetic fiber has a length of from about 154 to about $\frac{5}{8}$ inches.

17. The paper product of claim 1, wherein the synthetic fiber is a polyester resin.

18. The paper product of claim 15, wherein the synthetic fiber has a length of about 0.5 inches.

19. An abrasive material comprised of a backing layer and an abrasive layer, with the backing layer being comprised of the paper product of claim 1.

20. An abrasive material comprised of a backing layer and an abrasive layer, with the backing layer being comprised of the paper product of claim 11.

21. The paper product of claim 1, wherein the amount of binder ranges from about 10 to about 20 weight %.

22. A process for producing a high tensile strength, high tear strength paper product which comprises creating an aqueous slurry of wood pulp fiber, a non-cellulosic fiber having a denier in the range of from about 5 to about 15 and a length of 0.25 to about 0.75 inch, and a binder material, dewatering the slurry and then drying the paper product so as to obtain a product in which the amount of wood pulp fiber ranges from about 60 to about 98 weight %; the amount of non-cellulosic fibers ranges from about 1 to about 20 weight % and the amount of binder material ranges from about 1 to about 20 weight % and the strength of the non-cellulosic fiber exceeds non-cellulosic fiber bonding to the wood pulp fiber such that the non-cellulosic fiber tends to pull out of the paper product rather than rupture when the paper product is torn, and with the tensile strength being substantially maintained.

23. The process of claim 22, which further comprises refining said wood pulp to 250 ml CSF prior to creating the aqueous slurry.

24. The process of claim 22, wherein the binder material is added as a polymeric powder.

25. The process of claim 24, wherein the polymeric powder comprises polyvinyl alcohol.

26. A high tensile strength, high tear strength paper product prepared by the process of claim 22.

27. A high tensile strength, high tear strength paper product prepared by the process of claim 25.

* * * * *